United States Patent [19]

Ogawa et al.

[11] Patent Number: 4,536,448

[45] Date of Patent: Aug. 20, 1985

[54] PREOXIDIZED FIBER AND PROCESS FOR PRODUCING THE SAME

[76] Inventors: Hiroyasu Ogawa, No. 16-10, Hatsunedai, Mishima-shi; Tetsuro Shigei, No. 234 Minami Isshiki, Nagaizumi-cho, Sunto-gun, Shizuoka; Hayashi Takahashi, No. 66-5, Minami Isshiki, Nagaizumi-cho, Sunto-gun, Shizuoka; Tetuya Okabe, No. 3-2, Mizukubo, Susono-shi, Shizuoka; Fumio Miyatake, No. 234, Minami Isshiki; Nagaizumi-cuo, Sunto-gun, Shizuoka, all of Japan

[21] Appl. No.: 530,326

[22] Filed: Sep. 8, 1983

Related U.S. Application Data

[63] Continuation-in-part of Ser. No. 333,959, Dec. 23, 1981, abandoned.

[30] Foreign Application Priority Data

Dec. 27, 1980 [JP] Japan ..... 55-185528

[51] Int. Cl.[3] ..... C01B 31/07; D02G 3/00

[52] U.S. Cl. ..... 428/394; 264/29.2; 427/227; 427/384; 427/394; 428/367

[58] Field of Search ..... 428/367, 375, 394; 252/8.8 R, 8.8 AJ; 8/115.6; 264/29.2, 29.6; 423/447.4, 447.5, 447.6, 447.7, 447.1, 447.2; 427/227, 384, 394

[56] References Cited

U.S. PATENT DOCUMENTS

| | | | |
|---|---|---|---|
| 2,626,876 | 1/1953 | Carnes | 428/265 |
| 3,048,539 | 8/1962 | Kocay et al. | 252/8.8 R |
| 4,024,227 | 5/1977 | Kishimoto et al. | 264/29.2 X |

*Primary Examiner*—Lorraine T. Kendell

*Attorney, Agent, or Firm*—Sughrue, Mion, Zinn, Macpeak, and Seas

[57] ABSTRACT

A preoxidized fiber suitable for producing carbon fiber, comprising preoxidizing an acrylic fiber having thereon an ammonium salt of a fatty ester represented by formula [A] and [B]

[A]

[B]

wherein $R_1$ is an aliphatic hydrocarbon group having from 11 to 17 carbon atoms; $R_2$ and $R_3$ can each be hydrogen, a lower alkyl group, a hydroxyethyl group, or an hydroxyisopropyl group; and $X^{\ominus}$ is an anion.

The preoxidized fiber produced from the acrylic fiber has very little coalescence, and therefore high-strength carbon fiber can be obtained from this preoxidized fiber.

20 Claims, 1 Drawing Figure

PREOXIDIZED FIBER AND PROCESS FOR PRODUCING THE SAME

This application is a continuation-in-part of application Ser. No. 333,959, filed Dec. 23, 1981, now abandoned.

FIELD OF THE INVENTION

The present invention relates to preoxidized (flame-resistant) fiber having substantially no fiber coalescence and suitable for producing therefrom high-strength carbon fiber. The present invention also relates to a process for producing the preoxidized fiber from the acrylic fiber and a process for carbonizing the preoxidized fiber.

BACKGROUND OF THE INVENTION

Heretofore, it has been known that acrylic fiber can be preoxidized (i.e., made flame-resistant) by subjecting it to a preoxidization (flame-resistance) treatment by subjecting it to tension in air at a temperature of from 200° C. to 400° C., and that carbon fiber can be obtained therefrom by carbonizing said preoxidized fiber under tension in an inert atmosphere at 500° C. and up. (These methods are described in, for example, U.S. Pat. No. 4,069,297.)

Preoxidized fiber has found use as a flame-resistant material, a heat-shield material, a packing material, etc., but there has been a continuing demand for further improvements in the quality and performance thereof.

Carbon fiber produced as mentioned above is being used in sporting goods, leisure goods, automobiles, high speed driving device, for example, centrifugal separator, spacecraft, etc. because of its high specific tensile strength (tensile strength/specific gravity) and specific tensile modulus (tensile modulus/specific gravity), and the demand for it is increasing. Recently, there have been some application areas wherein even currently available carbon fibers having a tensile strength of from 300 to 350 kg/mm$^2$ have not been satisfactory. In such areas, carbon fibers having much higher tensile strength are required.

SUMMARY OF THE INVENTION

It is an object of the present invention to provide preoxidized fiber having substantially no fiber coalescence and a process for producing the preoxidized fiber.

It is another object of the present invention to provide a preoxidized fiber suitable for producing therefrom high-strength carbon fiber and a process for producing the carbon fiber.

In order to meet the requirement and objects noted above, the present inventors carried out extensive research, resulting in the findings that conventional preoxidized fiber is poor in quality and performance and that the conventional carbon fiber derived from conventional preoxidized fiber is low in tensile strength, on account of coalescence between monofilaments during the preoxidation treatment. The present invention has been made based on these findings.

The present invention relates to a method for producing preoxidized fiber, comprising preoxidizing an acrylic fiber having thereon an ammonium salt of a fatty ester or an ammonium salt of a fatty amide represented by the formulae [A] and [B]

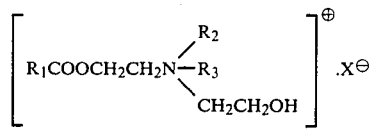

(A)

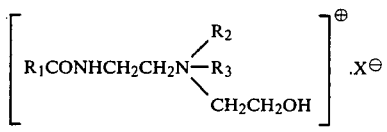

(B)

wherein $R_1$ is an aliphatic hydrocarbon group having from 11 to 17 carbon atoms; $R_2$ and $R_3$ can each be hydrogen, lower alkyl group, hydroxyethyl group, and hydroxyisopropyl group; and $X^{\ominus}$ is an anion.

The above-mentioned acrylic fiber can be obtained by treating acrylic fiber with the above-mentioned ammonium salt in any stage after removal of solvent in or after the process of producing acrylic fiber by a wet spinning process.

Furthermore, the present invention also relates to a process for preoxidation of the acrylic fiber thus obtained and a process for carbonizing the preoxidized fiber thus prepared.

DETAILED DESCRIPTION OF THE INVENTION

Figure 1:
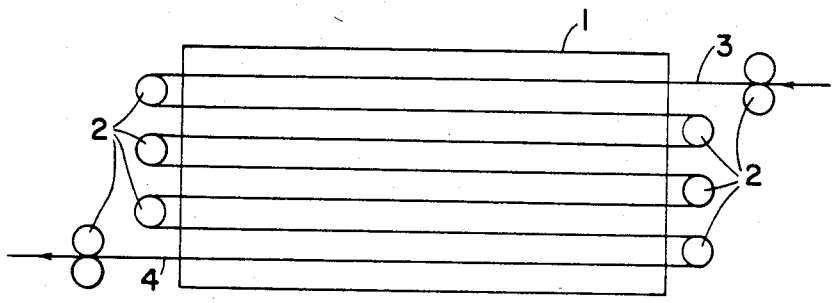
FIG. 1 is a schematic view showing an example of an apparatus for the preoxidation of acrylic fiber.

As mentioned above, it is possible to obtain preoxidized fibers having no fiber coalescence by treating raw acrylic fiber with a specific ammonium salt. It is also possible to obtain high-strength carbon fiber by carbonizing the preoxidized fiber thus obtained. Preoxidized fiber and carbon fiber according to this invention is thus improved in its spinning property. For obtaining high-strength carbon fiber, the acrylic fiber of this invention preferably consists of a polymer obtained from at least 95 mol% of acrylonitrile and not more than 5 mol% of vinyl monomer which is copolymerizable with acrylonitrile. The vinyl comonomer is one which is commonly used in the production of acrylic fiber. Examples of such vinyl comonomer include neutral monomers such as methyl acrylate, ethyl acrylate, and vinyl acetate; acid group-containing monomers such as acrylic acid, methacrylic acid, itaconic acid, salts thereof, sodium allylsulfonate, and sodium methallylsulfonate; and basic monomers such as vinyl pyridine and vinyl imidazole.

The above-mentioned acrylic fiber can be produced by a conventional known process. For instance, acrylonitrile, with or without copolymerizable vinyl monomer, is polymerized in an appropriate solvent (such as dimethylformamide, concentrated aqueous zinc chloride solution, dimethyl sulfoxide, and dimethylacetamide which dissolve polyacrylonitrile) in the presence of a proper catalyst (such as benzoyl peroxide, hydrogen peroxide, and sodium persulfate). The resulting solution of acrylonitrile polymer generally, having a molecular weight from about 40,000 to about 100,000, is extruded from spinnerets into a dilute solution of the solvent. After removal of solvent, the fiber is dried, stretched, and relieved. The resulting fiber bundle generally consists of from about 500 to about 100,000 monofilaments of 0.1 to 3.0 denier.

Acrylic fiber which is used in the present invention is obtained by treating acrylic fiber with an ammonium salt of fatty ester or fatty amide represented by the formula [A] or [B]. In these formulae, $R_1$ is an aliphatic hydrocarbon group having from 11 to 17 carbon atoms, and preferably is a linear saturated aliphatic hydrocarbon group; $R_2$ and $R_3$ are hydrogen, lower alkyl groups having preferably from 1 to 3 carbon atoms such as methyl and ethyl groups, hydroxyethyl group and hydroxyisopropyl group; and X is an anion, such as chlorine ion, acetate ion, lactate ion, phosphate ion, sulfate ion, borate ion, nitrate ion, and phosphoryl dioxy ethanol ion, or chlorine.

The ammonium salts of these formulae can be used alone or in combination of two or more of these ammonium salts for the treatment of the acrylonitrile fiber. An ammonium salt of fatty ester and an ammonium salt of fatty amide may be combined.

Examples of the compound represented by formula [A] are listed below.

(1)

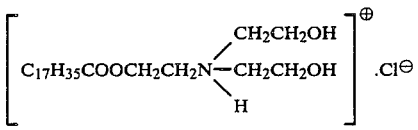

(2)

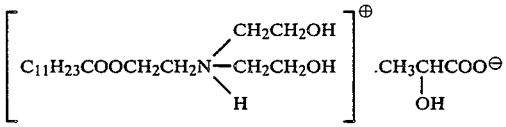

(3)

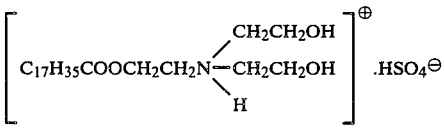

(4)

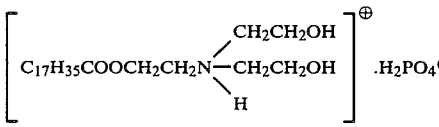

(5)

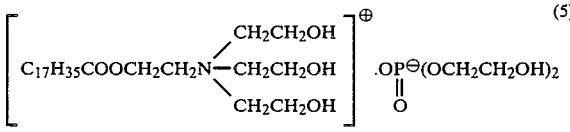

(6)

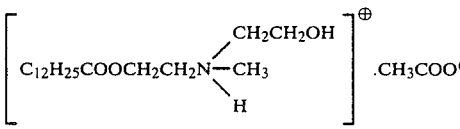

(7)

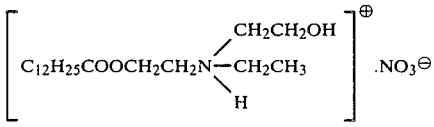

-continued (8)

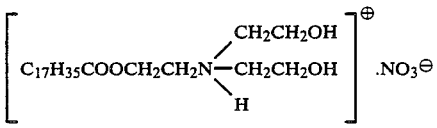

(9)

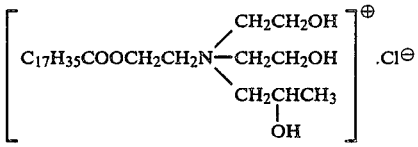

Examples of the compound represented by the formula [B] are listed below.

(1)

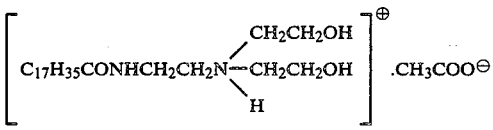

(2)

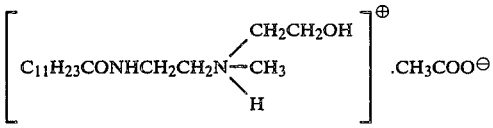

(3)

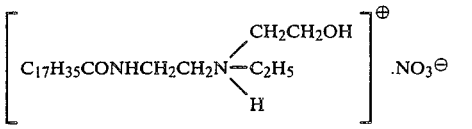

(4)

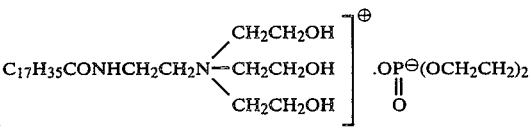

(5)

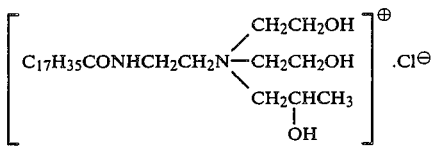

Among these examples, (1), (4), (5) and (9) of compound [A] and (1), (4) and (5) of compound [B] provide a particularly excellent effect in preventing coalescence of preoxidized fibers, and such compounds are preferably used in the production of preoxidized fiber intended for production of carbon fibers.

Compounds [A]-(5) and [B]-(4) have high solubility in water, therefore, they can form aqueous solutions. Compounds [A]-(1), (2), (3), (4), (8) and (9) and [B]-(1) and (5) have comparatively low solubility in water, therefore, they do not form clear aqueous solutions. (Such solutions may be represented as "dispersions".) Compounds [A]-(6), (7), [B]-(2) and (3) have low solubility in water, therefore, they provide dispersion. These compounds preferably are used in combination with an ammonium compound of the present invention having a high solubility to obtain stable liquids.

The above listed ammonium salts can be produced according to the following reaction formulae.

Production of compound [A]:

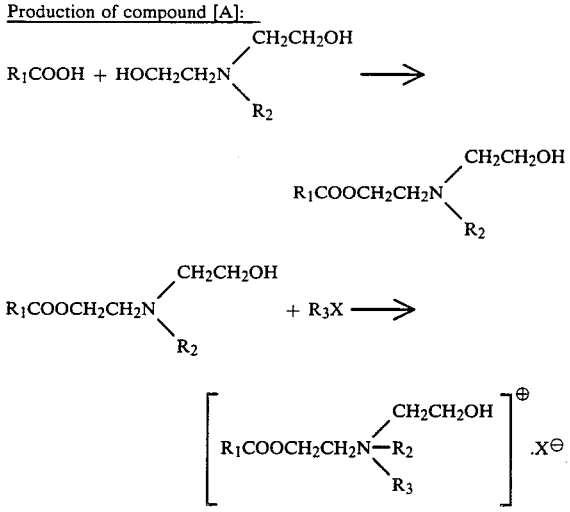

Production of compound [B]:

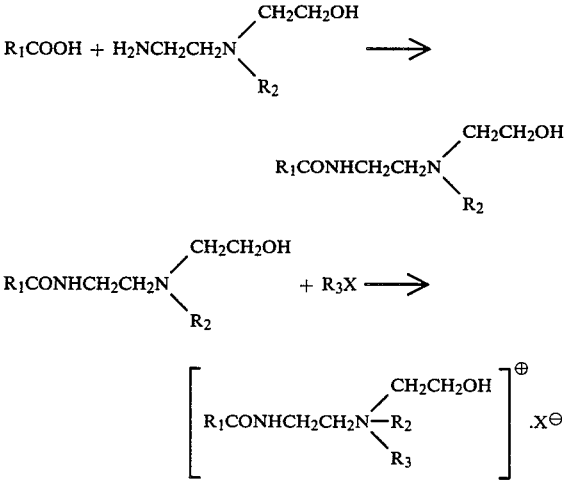

In the reaction formulae, $R_1$, $R_2$, $R_3$, and X are the same as defined above. In the above methods, the reactants are preferably used in equivalent amounts; furthermore, the first stage of each of the reactions is carried out with vigorous agitation at from about 100° C. to 200° C. for from 5 to 15 hours, and the second stage of each of the reactions is carried out at from 150° C. to 200° C. for from 5 to 15 hours.

It is to be noted that the ammonium salt used in this invention has at least one hydroxyl-containing group attached to the nitrogen atom and consequently are very soluble and dispersible in water. Nevertheless, permeability of the ammonium salt into the fiber is very small, and it deposits substantially uniformly on the surface of the fiber. In addition, the ammonium salt has a characteristic property that it grows into a larger molecule (it is considered that plural, usually 2–4, of molecules are combined) and/or reacts with the surface of the fiber by heating. Because of this property, the ammonium salt also prevents the molecular orientation from becoming irregular due to shrinkage caused by thermal motion of molecules at the surface of the fiber.

In the production of acrylic fiber by a wet spinning process, the fiber is usually dried, stretched, and relieved after removal of solvent which is used for preparing a spinning solution. According to the process of this invention, the treatment with the ammonium salt may be carried out in any stage after removal of solvent in the production of fiber. In other words, such treatment may be performed during any one of the above steps, between any two of the above steps, or after the production of the fiber.

Usually, the treatment with the ammonium salt is performed by dipping the fiber bundle in, or spraying the fiber with, an aqueous solution or dispersion of the ammonium salt. In order to get the fiber bundle completely wet, dipping is preferably performed, at a bath temperature of from 20° C. to 70° C. for from 1 to 5 minutes.

At a bath temperature higher than 70° C., the ammonium salt tends to aggregate in the solution with the result that the treatment becomes uneven, the ammonium salt infiltrate into the fiber, and the resulting carbon fiber has a decreased tensile strength. On the other hand, at a bath temperature lower than 20° C., the ammonium salt does not dissolve or disperse readily into the water, resulting in an uneven treatment fiber coalescence due to the large size of dispersed particles. The concentration of the ammonium salt is usually from 1 to 20 g/liter. The pH of the ammonium salt solution affects the quality of the resulting preoxidized fiber and carbon fiber, and a pH of 4 or less is preferable. If the pH is higher than 4, the ammonium salt tends to aggregate and tends to promote fiber coalescence. Any pH value lower than 4 is preferable, but more preferably it is more than 1 and most preferably it is from 2 to 3.5. The pH is preferably adjusted with sodium hydroxide or an acid having the same anion as X of the ammonium salt used.

The preferable quantity of the ammonium salt to be adhered to the fiber is from 0.01 to 0.5% based on the weight of the fiber. When the amount of less than 0.01%, the effect of preventing fiber coalescence is not sufficient, and when the amount of more than 0.5%, the excess ammonium salt forms a char and carbon on the preoxidized fiber and the carbon fiber surface, resulting in a decrease in the strength of the resulting carbon fiber. The preferable amount of the ammonium salt is less than 0.3%, at which the ammonium salt infiltrates into the fiber only slightly, and a high-strength carbon fiber can be obtained therefrom.

After the treatment with the solution containing the ammonium salt, the acrylic fiber is dried carefully so that the resulting carbon fiber is not adversely affected in strength. The fiber bundle which is in the form of gel (water content of fiber is more than about 5%), is usually dried by heating gradually to from 70° C. to 140° C., and the fiber bundle which is not in the form of gel (water content of fiber is not more than about 5%) is dried by heating gradually to from 100° C. to 150° C.

The quantity of the ammonium salt adhered to the fiber is measured by extraction with a mixture of alcohol and benzene (equal parts by weight) for 3 hours using a Soxhlet apparatus.

When the acrylic fiber treated with the ammonium salt is heated to 200° to 300° C., the ammonium salt becomes insoluble in water and also undergoes a change which suggests reaction with the acrylonitrile fiber. It is possible to cause the ammonium salt to change as above by heating the fiber before (or without) undergoing oxidation. This heating usually is conducted for from 0.7 to 2 minutes and the ammonium salt insolubilizes before oxidation reaction of the fiber starts. The reacted salt covers the fiber with very small amount of infiltration into the fiber. This heat treatment is preferably carried out at a temperature higher than 230° C. For heat treatment higher than 200° C., the temperature is preferably increased at a rate of 10° C./sec or less, and more preferably, from 1° to 5° C./sec. Such gradual heating is effective to prevent the fiber from coalescencing, because of infiltration of the salt into the fiber is prevented, and it is effective to obtain preoxidized fiber preferably used for the production of particularly high-strength carbon fiber. The acrylic fiber which has undergone the heat treatment (pretreated) may be subjected directly to a conventional preoxidation process or may be wound up before subjecting to the preoxidation process.

The acrylic fiber treated with the ammonium salt undergoes the process for preoxidation, with or without the above-mentioned heat treatment. The process for preoxidation is carried out by a known conventional method. The acrylic fiber is heated at a temperature from 200° C. to 400° C., and preferably from 250° C. to 300° C., in an oxidizing atmosphere for from 0.1 to 15 hours. When acrylic fiber treated with an ammonium salt but not heat treated is directly subjected to such a preoxidation process the ammonium salt also insolubilizes at the start of the preoxidation process. In a conventional preoxidation method the rate for raising the temperature of the fiber is not specifically controlled, and therefore the temperature of the fiber is typically increased in a rate more than about 25° C./sec. This oxidation treatment is preferably performed under a tension of from 10 to 100 mg/dnier to obtain high-strength carbon fiber. The tension is usually increased to 200 mg/denier if it is desirable to obtain carbon fiber of much higher strength. The carbonization treatment is preferably performed until the specific gravity of the fiber becomes 1.30 to 1.45 g/cm$^3$.

The preoxidized fiber thus-obtained has very little coalescence and is suitable for producing high-strength carbon fiber by carbonization.

The carbonization process for the preoxidized fiber is usually performed at from 1000° C. to 1500° C. in an inert atmosphere such as nitrogen, argon, or helium and preferably while under a tension of from 10 to 100 mg/denier.

The carbon fiber produced as mentioned above from the acrylic fiber of this invention have very high strength.

The invention is illustrated by the following examples. The "%" and "part" values set forth in the examples are expressed on a weight basis, unless otherwise specified.

EXAMPLE 1

An acrylic polymer solution was prepared as follows: Into 1000 parts of 60% aqueous zinc chloride solution 100 parts of a mixture of acrylonitrile (98 mol%), acrylic acid (0.5 mol%), and methyl acrylate (1.5 mol%) and 1 part of ammonium persulfate were dissolved. The reactants were allowed to polymerize at about 55° C. for 4 hours, to provide a solution having a viscosity of 98 poise. According to Staudinger's vicosity law, the resulting polymer had a molecular weight of about 55,000. This solution was extruded through a spinning nozzle having 10,000 holes, each measuring 0.05 mm in diameter, into 25% aqueous zinc chloride solution. The resulting fiber was washed with water to remove zinc chloride and stretched to three times its original length simultaneously, and then dried. The dried fiber was further stretched five times to provide acrylic fiber having filament denier of 1.0, tensile strength of 5.5 g/denier, and tensile elongation of 10%.

An ammonium salt of stearic ester of formula [A]-(1) was prepared by heating an equimolar mixture of stearic acid and triethanol amine at 165° C. for 10 hours, and then heating the resulting compound with an equimolar amount of 36% HCl at 50° C. The resulting ammonium salt was dissolved in water at a concentration of 5 g/liter to obtain an aqueous solution (dispersion) having pH 3.6. Into this solution was dipped the previously prepared acrylic fiber at 50° C. for 0.5 minutes, followed by drying at a temperature of 110° C. The quantity of the ammonium salt picked up by the acrylic fiber was found to be 0.05% by extraction with 100 ml of a 1:1 alcohol/benzene mixture using a Soxhlet apparatus.

The treated acrylic fiber was heated at 260° C. for 1.5 hours in air under a tension of 30 mg/denier. The temperature was raised from 200° C. to 260° C. at a rate of about 8°/sec. The resulting preoxidized fiber had a specific gravity of 1.40 g/cc, tensile strength of 3.3 g/denier, and tensile elongation of 10%. According to electron microscopy, no fiber coalescence was observed.

This preoxidized fiber was then carbonized at 1400° C. for 1 minute in a nitrogen stream under a tension of 30 mg/denier to provide a high strength carbon fiber having tensile strength of 380 kg/mm$^2$ and tensile modulus of 24,500 kg/mm$^2$. According to electron microscopy, no fiber coalescence was observed.

EXAMPLE 2

As in Example 1, the solution of acrylic polymer was spun, and the resulting fiber was washed with water to remove zinc chloride and stretched to three times its original length simultaneously.

An ammonium salt of stearic amide of formula [B]-(1) was prepared by heating an equimolar mixture of stearic acid and diethanolethylenediamine at 180° C. for 15 hours and then heating the resulting compound with an equimolar amount of 99% acetic acid at 90° C. The resulting ammonium salt was adjusted to pH 3.5 with a buffer solution of acetic acid and ammonium acetate, whereby an aqueous solution having a concentration of 4 g/liter was obtained. The previously prepared acrylic fiber was dipped into this solution at 60° C. for 0.2 minutes, followed by drying at 120° C. (drying temperature was raised gradually). Successively, the treated acrylic fiber was then stretched to 4.5 times its length in saturated steam at 125° C. The resulting fiber had filament denier of 1.1, tensile strength of 5.3 g/denier, and elongation of 12%. The pickup of the ammonium salt attached to the acrylic fiber was found to be 0.025% when measured as in Example 1.

The treated acrylic fiber was preoxidized at 255° C. for 40 minutes in air under a tension of 50 mg/denier, and then at 280° C. for 20 minutes under a tension of 40 mg/denier. The temperature was raised from 200° C. to 255° C. at a rate of about 30° C./sec. The resulting preoxidized fiber had a specific gravity of 1.39 g/cc, tensile strength of 3.4 g/denier, and tensile elongation of 13%. According to electron microscopy, no fiber coalescence was observed.

This flame-resistant fiber was then carbonized at 1300° C. for 40 seconds in a nitrogen stream under a tension of 50 mg/denier to provide carbon fiber having tensile strength of 402 kg/mm$^2$ and tensile modulus of 24,400 kg/mm$^2$. According to electron microscopy, no fiber coalescence was observed.

EXAMPLE 3

Compounds [A]-(2), [A]-(5), [A]-(9), and a 1:1 mixture of [A]-(2) and [A]-(9) were adjusted to a concentration of 4 g/liter and pH 3.3 using 36% HCl or NaOH.

Acrylic fibers were treated with these four kinds of ammonium salt solutions (or dispersions) as in Example 2. The resulting treated fibers had properties as shown in Table 1.

TABLE 1

| Ammonium Salt | Tensile Strength | Tensile Elongation | Fineness |
|---|---|---|---|
| [A]-(2) | 5.4 g/denier | 11.0% | 1.1 denier |
| [A]-(5) | 5.5 | 11.7 | 1.1 |
| [A]-(9) | 5.4 | 11.5 | 1.1 |
| [A]-(2) / [A]-(9) | 5.6 | 12.0 | 1.1 |

The resulting preoxidized fiber had properties as shown in Table 2. According to electron microscopy, substantially no fiber coalescence was observed.

TABLE 2

| Ammonium Salt | Tensile Strength | Tensile Elongation | Specific Gravity |
|---|---|---|---|
| [A]-(2) | 3.0 g/denier | 13.0% | 1.40 g/cc |
| [A]-(5) | 3.2 | 13.5 | 1.40 |
| [A]-(9) | 3.1 | 13.3 | 1.40 |
| [A]-(2) / [A]-(9) | 3.3 | 14.0 | 1.40 |

The four kinds of the treated fibers were subjected to heat treatment as in Example 2 to obtain carbon fibers.

The resulting carbon fibers had properties as shown in Table 3 and had no fiber coalescence as in the preoxidized fiber.

TABLE 3

| Ammonium Salt | Tensile Strength | Tensile Modulus |
|---|---|---|
| [A]-(2) | 395 kg/mm$^2$ | 24,300 kg/mm$^2$ |
| [A]-(5) | 430 | 24,400 |
| [A]-(9) | 420 | 24,400 |
| [A]-(2) / [A]-(9) | 408 | 24,300 |

COMPARATIVE EXAMPLE 1

The treatment as in Example 2 was repeated except that the ammonium salt solution was replaced by a solution of 50° C. having a pH of 3.3, containing 4 g/liter of siloxane having 15 mols of polyoxyethylene added thereto. The resulting acrylic fiber and preoxidized fiber was the same in physical properties and coalescence as those obtained in Example 3. However, the resulting carbon fiber had a tensile strength of 345 kg/mm$^2$ and tensile modulus of 24,200 kg/mm$^2$. The carbon fiber obtained in this comparative example was poorer in tensile strength as compared with that obtained with the ammonium salt of this invention. Although no fiber coalescence was observed, silicone residues were observed in the fiber. This is considered to be a cause of lower tensile strength.

EXAMPLE 4

Example 1 was repeated except that the concentration of the ammonium salt bath was changed so that the deposition of the ammonium salt was adjusted to 0.015%, 0.025%, and 0.038%, respectively.

The resulting carbon fibers had tensile strengths of 415 kg/mm$^2$, 405 kg/mm$^2$, and 358 kg/mm$^2$, respectively, and a tensile modulus of 24,500 kg/mm$^2$ in all cases.

EXAMPLE 5

Example 1 was repeated except that the ammonium salt solutions were adjusted to a pH of 3.0 and a pH of 4.8, with hydrochloric acid and sodium hydroxide, respectively.

The resulting carbon fibers had tensile strength of 415 kg/mm$^2$ and 360 kg/mm$^2$, respectively, and tensile modulus of 24,400 kg/mm$^2$ regardless of pH.

COMPARATIVE EXAMPLE 2

The acrylic fiber was treated with three kinds of ammonium salts of the following formula (wherein n was 3, 5 and 20, respectively) which are outside of the scope of this invention.

$$\left[C_{17}H_{35}COO(CH_2CH_2O)_nCH_2CH_2N\begin{matrix}CH_2CH_2OH\\CH_2CH_2OH\\H\end{matrix}\right]^{\oplus}.H_2PO_4^{\ominus}$$

The resulting carbon fibers had tensile strength of 330 kg/mm$^2$ when n was 3, 320 kg/mm$^2$ when n was 5, and 308 kg/mm$^2$ when n was 20.

EXAMPLE 6

An acrylic polymer solution was prepared as follows: Into 1000 parts of 60% aqueous zinc chloride solution, 95 parts of a monomer mixture of acrylonitrile (97 mol%), methyl acrylate (2.5 mol%), and sodium metallyl sulfonic acid (0.5 mol%), and 0.85 part of ammonium persulfate were dissolved. The reactants were allowed to polymerize at 50° C. for 5 hours, to provide a solution having a viscosity of 100 poise (at 45° C.). According to Staudinger's viscosity law, the resulting polymer had a molecular weight of 75,000. This solution was extruded through a spinning nozzle having 48,000 holes, each measuring 0.06 mm in diameter, into a 28% aqueous zinc chloride solution. The resulting fiber was washed with water to remove zinc chloride and stretched to 2.5 times its original length simultaneously, and then passed through the aqueous dispersion containing 7 g/liter of the ammonium salt of stearic ester represented by formula [A]-(1), at 45° C. for 0.2 minute, followed by drying for 10 minutes at 105° C. and for 15 minutes at 120° C. Successively, the dried fiber was further stretched to 5.5 times its strength in saturated steam at 115° C., followed by 4% shrinkage in saturated steam at 120° C. for 0.3 minute, to provide acrylic fiber having filament denier of 1.5, a tensile strength of 5 g/denier, and tensile elongation of 15%.

The resulting acrylic fiber was subjected to heat treatment for preoxidation using a oven equipped with several sets of rollers as shown in FIG. 1, in which 1 denotes the oven, 2 denotes the rollers, 3 denotes acrylic fiber, and 4 denotes preoxidized fiber. This heat treatment was carried out at 250° C. for 2 hours so that the total shrinkage was 10%. (The temperature was raised from 200° C. to 250° C. at a rate of 25° C./sec.) The resulting preoxidized fiber had a specific gravity of 1.42 g/cc, a tensile strength of 3.1 g/denier, and tensile elongation of 15%. According to electron microscopy, no fiber coalescence was observed.

The preoxidized fiber was converted to slivers using a Turbostapler and then converted to spun yarn using a ring frame. Problems such as end breakages and napping were not encountered in the spinning process.

The preoxidized fiber thus obtained was carbonized in the same manner as in Example 1. The tensile strength of the thus obtained carbon fiber was 415 kg/mm$^2$.

COMPARATIVE EXAMPLE 3

Example 6 was repeated except that the ammonium salt of stearic ester represented by formula [A]-(1) was replaced by decyltrimethyl ammonium chloride, which is outside of the scope of this invention. The resulting carbon fiber had a tensile strength of 320 kg/mm$^2$, which is very poor as compared with that obtained in Example 6.

EXAMPLE 7

Acrylic fiber was treated with the ammonium salt as in Example 6. The treated acrylic fiber was subjected to heat treatment at 250° C. for 1 minute, while permitting 3% shrinkage. The temperature was raised from 200° C. to 250° C. at a rate of 7° C./sec and kept it at 250° C. for 1 minute to insolubilize the ammonium salt. The resulting fiber had filament denier of 1.55, a tensile strength of 5 g/denier, and tensile elongation of 18%. Also, the resulting fiber had neither napping nor fiber coalescence.

This fiber was subjected to preoxidation as in Example 6 and then to carbonization as in Example 1. The resulting carbon fiber had an extremely high tensile strength of 425 kg/mm$^2$, and no coalescence was observed by electron microscopy.

EXAMPLE 8

Ammonium salt-treated acrylic fibers obtained as in Example 6 was subjected to heat treatment under the conditions as shown in Table 4 prior to subjecting to the preoxidation process. The pretreated fibers were preoxidized at 260° C. for 1.5 hours in air under a tension of 30 mg/denier using an apparatus as shown in FIG. 1. The resulting preoxidized fibers were then carbonized at 1400° C. in a nitrogen stream for 1 minute under a tension of 30 mg/denier. The resulting carbon fibers had tensile strengths as shown in Table 4.

Table 4 indicates that carbon fiber of much higher tensile strength can be obtained if the acrylic fiber treated with the ammonium salt is subjected to pretreatment prior to the preoxidation.

While the invention has been described in detail and with reference to specific embodiments thereof, it will be apparent to one skilled in the art that various changes and modifications can be made therein without departing from the spirit and scope thereof.

What is claimed is:

1. A process for producing a preoxidized fiber, comprising contacting an acrylic fiber with a solution or dispersion of an ammonium salt of a fatty ester at a temperature of from 20° to 70° C., which solution or dispersion is at a pH of 4 or less, which solution or dispersion contains said ammonium salt of a fatty ester in an amount sufficient to provide from 0.01 to 0.5%, based on the weight of the fiber, of said ammonium salt of a fatty ester on said fiber, said ammonium salt of a fatty ester being represented by formula [A]

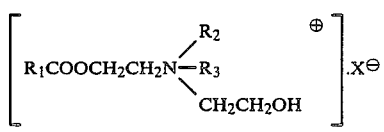

[A]

wherein $R_1$ is an aliphatic hydrocarbon group having from 11 to 17 carbon atoms; $R_2$ and $R_3$ can each be hydrogen, a lower alkyl group, a hydroxyethyl group, or an hydroxyisopropyl group; and $X^{\ominus}$ is an anion, drying said fiber, and thereafter preoxidizing said fiber.

2. A process as in claim 1, in which the acrylic fiber consists of a polymer obtained from at least 95 mol% acrylonitrile and not more than 5 mol% vinyl monomer copolymerizable with acrylonitrile.

3. A process as in claim 2, in which the vinyl monomer is at least one member selected from the group consisting of methyl acrylate, ethyl acrylate, vinyl acetate, acrylic acid, methacrylic acid, itaconic acid, and salts thereof, sodium allylsulfonate, and sodium methallylsulfonate, vinyl pyridine, and vinyl imidazole.

4. A process as in claim 1, in which $X^{\ominus}$ in the formula is a chlorine ion, an acetate ion, a lactate ion, a phosphate ion, a sulfate ion, a borate ion, a nitrate ion, or a phosphoryldioxyethanol ion.

5. A process as in claim 1, in which said lower alkyl group has from 1 to 3 carbon atoms.

6. A process as in claim 1, in which the compound represented by formula [A] is selected from the group

TABLE 4

| Dwell time at more than 200° C. (min)[1] | 0 | | 0.5 | | | 1.3 | |
|---|---|---|---|---|---|---|---|
| Max. temp. for heat treatment (°C.) | | 230 | 280 | 330 | 230 | 280 | 330 |
| Rate of temp. rise | | | | | | | |
| 5° C./sec | — | 395 kg/mm$^2$ | 393 kg/mm$^2$ | 289 kg/mm$^2$ | 413 kg/mm$^2$ | 414 kg/mm$^2$ | 270 kg/mm$^2$ |
| 8° C./sec | — | 389 | 390 | 280 | 415 | 413 | 253 |
| 13° C./sec | — | 378 | 379 | 273 | 395 | 391 | 240 |
| Treated at 180° C. for 1.3 min. | 383 kg/mm$^2$ | | | | | | |

[1]Total time for raising the heat temperature to the maximum temperature at the rate shown in the Table and the time of keeping the maximum temperature.

(1)

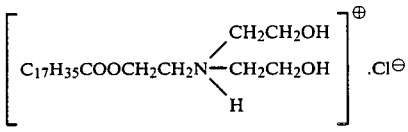

(2)

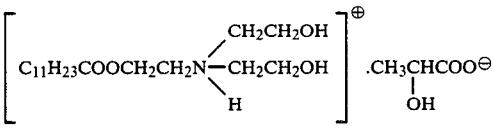

(3)

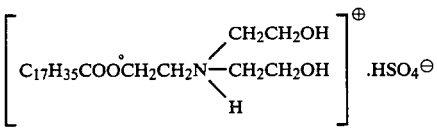

(4)

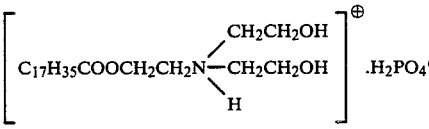

(5)

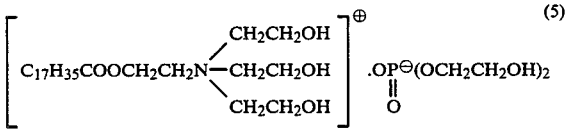

(6)

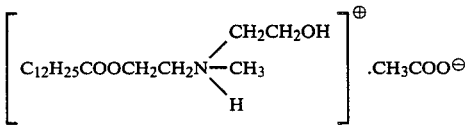

(7)

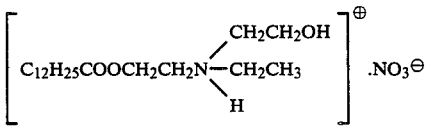

(8)

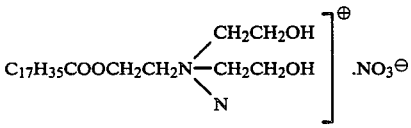

-continued (9)

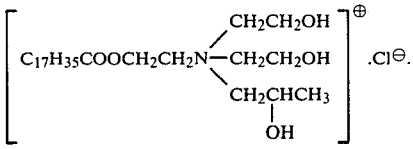

7. A process as in claim 1, in which the amount of the ammonium salt on the acrylic fiber is from less than 0.3%, based on the weight of the fiber.

8. A process as in claim 1, wherein said acrylic fiber being produced by treating a raw acrylic fiber at any stage from the removal of solvent to the finishing of production of the raw acrylic fiber or after the finishing of production of the raw acrylic fiber by a wet spinning.

9. A process as in claim 1, in which the pH is from 2 to 3.5.

10. A process as in claim 1, in which preoxidation is conducted at a temperature from 200° C. to 400° C. in an oxidizing atmosphere.

11. A process as in claim 10, in which preoxidation is conducted for from 0.1 to 1.5 hours.

12. A process as in claim 8, in which, after the treatment with the ammonium salt, the acrylonitrile fiber is subjected to heat treatment at from 200° C. to 300° C. to render the ammonium salt insoluble in water.

13. A process as in claim 12, in which the heat treatment is performed for from 0.7 to 2 minutes.

14. A process as in claim 12, in which the heat treatment is performed at from 230° C. to 300° C.

15. A process as in claim 12, in which the heat treatment is performed by raising the temperature at a rate of 10° C./sec or less after the temperature has reached 200° C.

16. A process as in claim 12, in which the heat treatment is performed by raising the temperature at a rate of from 1° to 5° C./sec after the temperature has reached 200° C.

17. A process as in claim 1, wherein $R_1$ is a linear saturated aliphatic carbon group.

18. A process as in claim 8, wherein the treatment of the acrylic fiber with ammonium salt is carried out by dipping the fiber in an aqueous solution or a dispersion of the ammonium salt.

19. Preoxidized fiber produced according to the process as claimed in claim 1.

20. A process as in claim 1, in which X⊖ in the formula is a phosphate ion, a sulfate ion, a borate ion or a phosphoryldioxyethanol ion.

* * * * *

UNITED STATES PATENT AND TRADEMARK OFFICE

CERTIFICATE OF CORRECTION

PATENT NO. : 4,536,448

DATED : August 20, 1985

INVENTOR(S) : Hiroyasu Ogawa, Tetsuro Shigei, Hayashi Takahashi, Tetuya Okabe and Fumio Miyatake It is certified that error appears in the above-identified patent and that said Letters Patent is hereby corrected as shown below: On the title page Please add the following --[73] Assignee TOHO BESLON COMPANY, LIMITED, TOKYO, JAPAN--

Signed and Sealed this

*Twenty-ninth* Day of *April 1986*

[SEAL]

*Attest:*

DONALD J. QUIGG

*Attesting Officer*

*Commissioner of Patents and Trademarks*